US005959267A

United States Patent [19]

Kawasaki et al.

[11] Patent Number: 5,959,267

[45] Date of Patent: Sep. 28, 1999

[54] ROTARY ELECTRICAL COMPONENT WITH PUSH SWITCH

[75] Inventors: Kenzo Kawasaki, Miyagi-ken; Satoshi Inoue, Nara-ken, both of Japan

[73] Assignee: Alps Electric Co., Ltd., Yokohama, Japan

[21] Appl. No.: 09/162,039

[22] Filed: Sep. 28, 1998

[30] Foreign Application Priority Data

Oct. 8, 1997 [JP] Japan ..... 9-275952

[51] Int. Cl.[6] ..... H01H 25/06

[52] U.S. Cl. ..... 200/4; 200/11 R

[58] Field of Search ..... 200/4, 5 R, 6 R, 200/7, 11 R, 14, 16 R, 17 R, 18, 336, 341, 345

[56] References Cited

U.S. PATENT DOCUMENTS

| | | | |
|---|---|---|---|
| 4,320,267 | 3/1982 | Greve et al. | 200/4 |
| 4,463,233 | 7/1984 | Tanabe | 200/159 A |
| 4,866,219 | 9/1989 | Riding et al. | 200/4 |
| 5,180,050 | 1/1993 | Rada et al. | 200/329 |
| 5,669,489 | 9/1997 | Von Ende | 200/570 |
| 5,705,778 | 1/1998 | Matsui et al. | 200/11 R |
| 5,744,873 | 4/1998 | Hasegawa et al. | 307/10.1 |
| 5,847,335 | 12/1998 | Sugahara et al. | 200/4 |

FOREIGN PATENT DOCUMENTS

| | | | |
|---|---|---|---|
| 8329790 | 12/1996 | Japan | H01H 25/04 |

*Primary Examiner*—Michael Friedhofer
*Attorney, Agent, or Firm*—Brinks Hofer Gilson & Lione

[57] ABSTRACT

A rotary elastic component with a push switch comprises a bearing having a through hole and a collar portion provided at the end to close a part of the through hole, a rotary electrical component having a rotating body with a hole, a push switch disposed at the rear of the rotary electrical component and having a moving contact and a stationary contact, and an operating shaft inserted into the through hole of the bearing and the hole of the rotating body and having a collar portion. The collar portion of the operating shaft is positioned within the through hole of the bearing, to thereby retain, by the collar portion of the bearing, the operating shaft from accidentally loosening from position. When the operating shaft is rotating, the rotating body is rotated to operate the rotary electrical component; the operating shaft being axially moved to actuate the push switch. Furthermore, an elastic member is mounted, within the through hole of the bearing, between the collar portion of the bearing and the collar portion of the operating shaft.

3 Claims, 3 Drawing Sheets

ROTARY ELECTRICAL COMPONENT WITH PUSH SWITCH

BACKGROUND OF THE INVENTION

1. Field of the Invention

The present invention relates to a rotary electrical component provided with a push switch which is operated on and off by the axial movement of an operating shaft, thereby to operate the rotary electrical component such as a pulse switch, a variable resistor, etc.

2. Description of the Prior Art

In this type of prior art rotary electrical component with a push switch, a bearing 31 has a housing section 31*a*, a through hole 31*b*, and a collar portion 31*c* provided on the end to close a part of the through hole 31*b* as shown in FIG. 5.

Within the housing section 31*a* of the bearing 31 are housed a rotatable magnetic drum 32 having a hole 32*a* at center, and a plurality of Hall ICs 33 fixed in an opposite position to the magnetic drum 32. The rotary electrical component D which is a rotary encoder is comprised of the magnetic drum 32 and the Hall ICs 33.

The magnetic drum 32 is provided with a projection-depression portion 32*b*. A spring 34 fixed inside of the housing section 31*a* can be engaged with, and disengaged from, the projection-depression portion 32*b*, so that the magnetic drum 32 can make a click operation when turning.

The operating shaft 35 has a round portion 35*b* with a groove 35*a*, a non-round portion 35*c* connected to the round portion 35*b*, and a projection 35*d* connected to the non-round portion 35*c*. The operating shaft 35 is inserted into the through hole 31*b* of the bearing 31 and the hole 32*a* of the magnetic drum 32; and the round portion 35*b* is positioned in the collar portion 31*c* and the non-round portion 35*c* in the hole 32*a*.

In the groove 35*a* of the operating shaft 35 a metal washer 36 is fitted in contact with the inside surface of the collar portion 31*c*, thereby preventing accidental removal of the operating shaft 35.

The operating shaft 35 thus installed is capable of rotation and axial movement. The operating shaft 35, when turned, rotates the round portion 35*b* in the collar portion 31*c* and also rotates the magnetic drum 32 through the non-round portion 35*c*. Also, the operating shaft 35, when axially moved, slides between the collar portion 31*c* and the hole 32*a*.

An insulating base 37 of a synthetic resin molding is disposed to cover the open part of the housing section 31*a* of the bearing 31, and a push switch P is mounted in a recess 37*a* of the insulating base 37.

The push switch P is comprised of a stationary contact 39 embedded in the casing 38, a moving contact 40 disposed within the casing 38, a dome-shaped rubber member 41 mounted within the casing 38 and disposed to cover the moving contact 40, and a plate member 42 so disposed as to cover the open part of the casing 38.

With the push switch P mounted at the rear of a rotary electrical component D, the rubber member 41 is in a position close oppositely to a projection 35*d* of the operating shaft 35, to press the operating shaft 35 forwardly.

In such a rotary electrical component with a push switch, when a knob 43 attached on the operating shaft 35 is turned, the magnetic drum 32 is turned by the operating shaft 35 while making a click operation. As the magnetic drum 32 turns, the Hall IC 33 generates an output signal to thereby operate the rotary electrical component D.

When the knob 43 is depressed to move in the axial direction, the operating shaft also moves to push the rubber member 41 with the projection 35*d*.

Then, the rubber member 41 is pressed to deflect until it depresses the moving contact 40, which in turn contacts the stationary contact 39 to be in ON state.

When the knob 43 is released from a pressure, the rubber member 41 resets itself by its own resilience to the original position. Thus the operating shaft 35 is pushed back by the rubber member 41 until the washer 36 is locked to the collar portion 31*c* and at the same time the moving contact 40 returns with its own resilience to the original position to be in OFF state, thereby operating the rotary electrical component D and the push switch P.

The conventional rotary electrical component with a push switch uses a washer 36 to lock the operating shaft 35 from accidental loosening from position. As the washer 36 is needed, the quantity of component parts will increase, resulting in lowered assembling efficiency and increased cost.

The operating shaft 35, when released after being pushed, is forced back and the washer 36 hits the collar portion 31*c*, producing a hitting sound, which grates on ears, and moreover deteriorating the quality of the electrical component.

The operating shaft 35 makes rotation and axial movement by means of the collar portion 31*c* of the bearing 31. In this case, however, the small-diameter portion of the operating shaft 35 is supported, which, however, presents the problem that the operating shaft 35 can not operate smoothly.

SUMMARY OF THE INVENTION

As the first means to solve the above-described problems, the rotary electrical component with a push switch includes a bearing having a through hole and a collar portion provided at the end to close a part of the through hole, a rotary electrical component having a rotating body with a hole, a push switch disposed at the rear of the rotary electrical component and having a moving contact and a stationary contact, and an operating shaft inserted into the through hole of the bearing and the hole of the rotating body and having a collar portion; the collar portion of the operating shaft being positioned within the through hole of the bearing, to thereby retain the operating shaft from loosening by means of the collar portion of the bearing. Then, with the operating shaft rotating, the rotating body is turned to operate the rotary electrical component. And the operating shaft is axially moved to actuate the push switch. Also, an elastic member is mounted, within the through hole of the bearing, between the collar portion of the bearing and the collar portion of the operating shaft.

Furthermore, as the second means of solution, the elastic member mentioned above is produced of a curved metal plate.

Furthermore, as the third means of solution, a projection is provided on at least either the collar portion of the bearing or the collar portion of the operating shaft, on the side where the collar portion of the bearing and the collar portion of the operating shaft face each other, to provide a smaller gap between the forward end of the projection and the collar portion facing the forward end than a gap between the collar portion of the bearing and the collar portion of the operating shaft where the elastic member is interposed.

DESCRIPTION OF THE PREFERRED EMBODIMENTS

Figure 1:
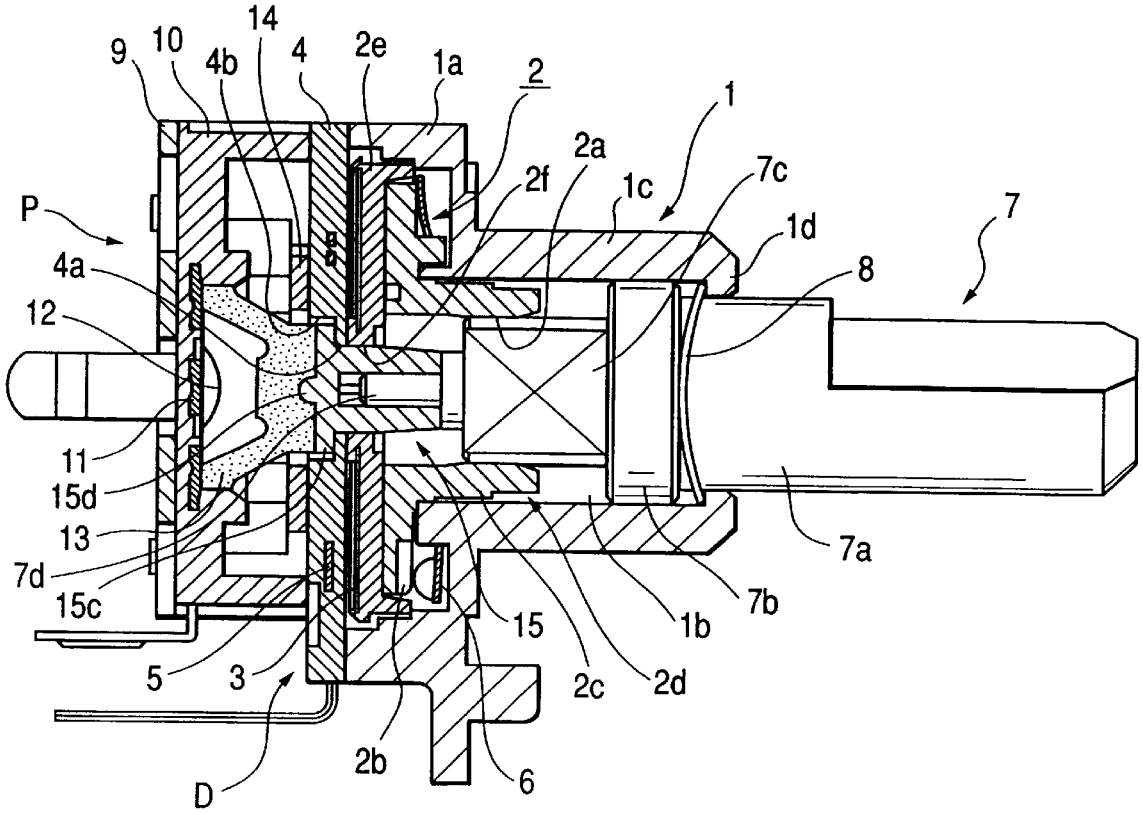
FIG. 1 is a sectional view of a rotary electrical component with push switch of the present invention.
Figure 2:
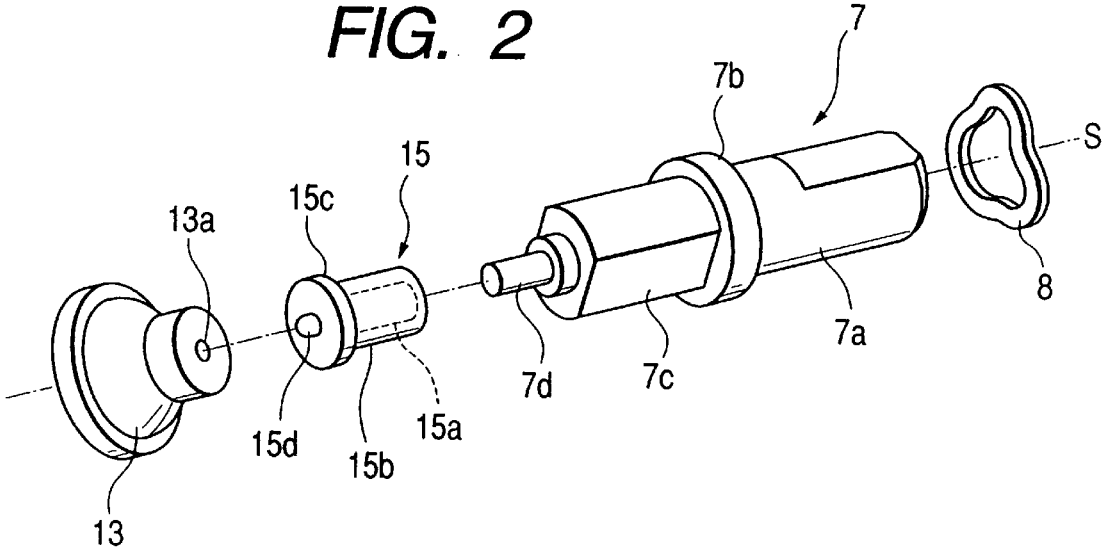
FIG. 2 is a perspective view of a major portion of the rotary electrical component with push switch of the present invention.
Figure 3:
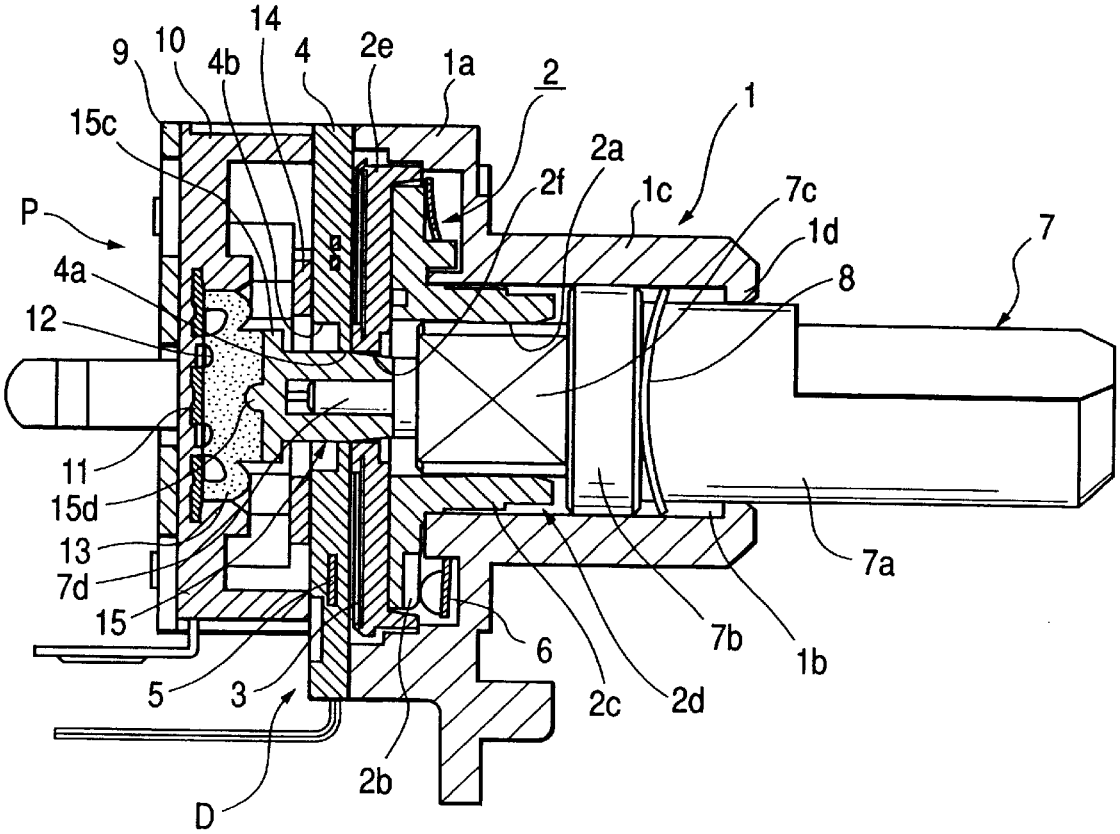
FIG. 3 is an explanatory view showing operation of the rotary electrical component with push switch of the present invention.
Figure 4:
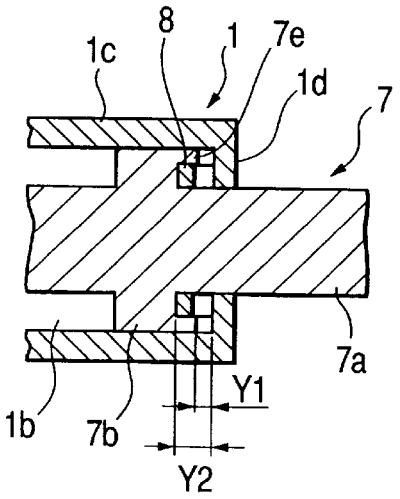
FIG. 4 is a sectional view of a major portion showing another embodiment of the rotary electrical component with push switch of the present invention.
Figure 5:
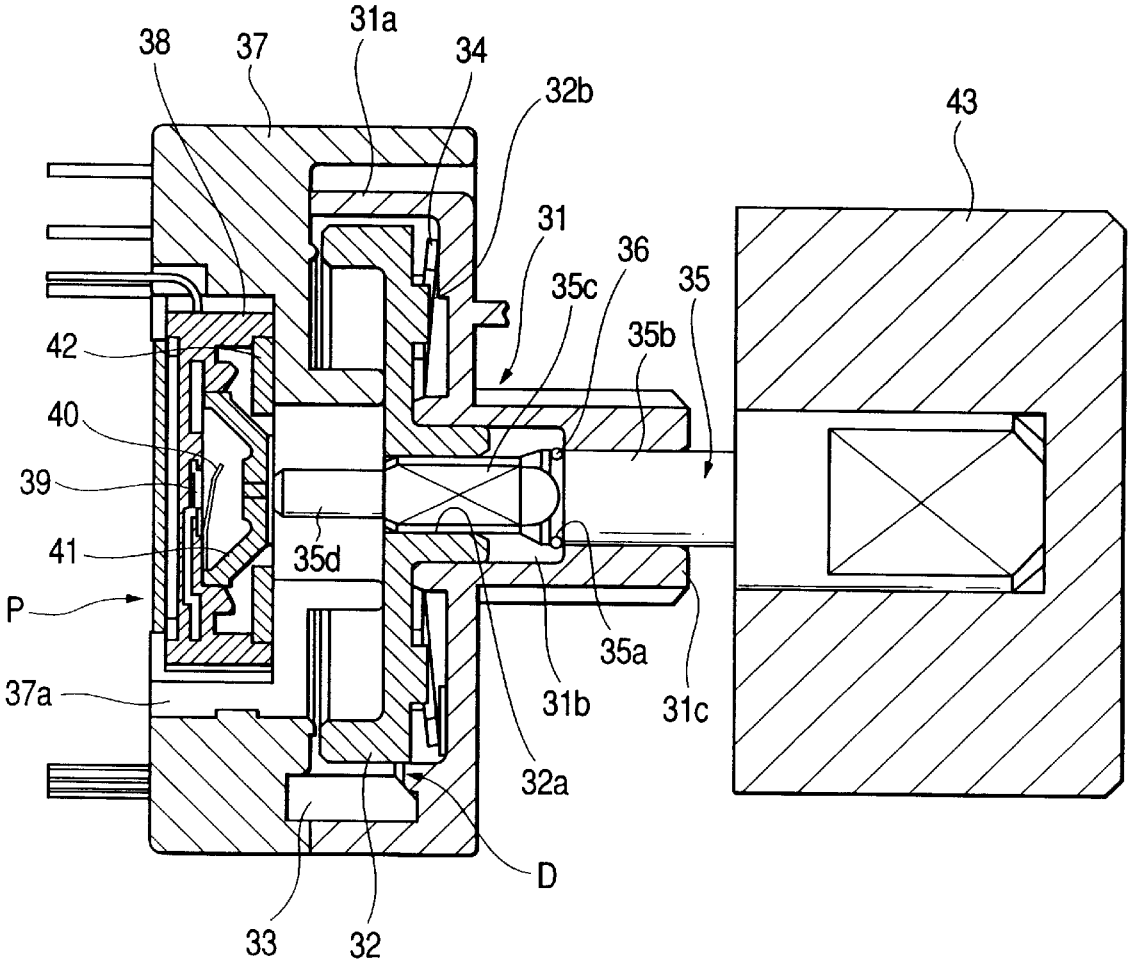
FIG. 5 PRIOR ART
FIG. 5 is a sectional view of a conventional rotary electrical component with push switch.

A rotary electrical component with push switch of the present invention will be described with reference to FIG. 1 to FIG. 4, wherein FIG. 1 is a sectional view of the rotary electrical component with push switch of the present invention; FIG. 2 is an exploded perspective view of a major portion of the rotary electrical component with push switch of the present invention; FIG. 3 is an explanatory view showing the operation of the rotary electrical component with push switch of the present invention; and FIG. 4 is a sectional view of a major portion showing another embodiment of the rotary electrical component with push switch of the present invention.

In the rotary electrical component with push switch of the present invention, a bearing 1 of zinc die casting has a housing section 1*a*, a cylindrical portion 1*c* with a through hole 1*b*, and a collar portion 1*d* provided at the end of the cylindrical portion 1*c* to close a part of the through hole 1*b*.

Within the housing section 1*a* of the bearing 1, there is disposed a rotatable rotating body 2 having a non-round hole 2*a* at center. The rotating body 2 is comprised of a holding section 2*d* produced of a metal and having a projection-depression portion 2*b* and a cylindrical portion 2*c*, and an insulating member 2*e* of a synthetic resin connected with the holding section 2*d*, and a moving contact 3 of a metal plate attached on the insulating member 2*e*. The cylindrical portion 2*c* of the rotating body 2 is inserted into the through hole 1*b* of the bearing 1, so that the rotating body can rotate with the bearing 1 as a guide.

In the mounting base 4 of a synthetic resin molding, a stationary contact 5 is embedded. The mounting base 4 is attached on the bearing 1 disposed to cover the open part of the housing section 1*a* of the bearing 1.

The rotary electrical component D which is a pulse switch is composed of a rotating body 2 having the moving contact 3 and the mounting base 4 having the stationary contact 5; an unillustrated elastic contact of the stationary contact 5 breaks and makes an electrical circuit in relation with the moving contact 3, thus operating the contact on and off.

The rotary electrical component D may be an encoder, a variable resistor, or other.

In the housing section 1*a* of the bearing 1 a spring 6 produced of a metal plate is fixed. The spring 6 is able to be engaged with, and released from, the projection-depression portion 2*b* of the rotating body 2, so that, during the rotation of the rotating body 2, the click operation can be made.

The operating shaft 7 produced of a metal has an operating portion 7*a*, a collar portion 7*b* having a larger-diameter round portion than the operating portion 7*a*, a non-round portion 7*c* provided in connection with the collar portion 7*b*, and a cylindrical engaging portion 7*d* provided in the axial center part in connection with the non-round portion 7*c*.

The operating shaft 7 is inserted in the through hole 1*b* of the bearing 1 and in the hole 2*a* of the rotating body 2, with the operating portion 7*a* positioned in the collar portion 1*d*, the collar portion 7*b* fitted in the through hole 1*b*, and further the non-round portion 7*c* positioned in the hole 2*a*. Therefore the operating shaft 7 is supported at the operating portion 7*a* by the collar portion 1*d*, making rotation and axial movement. The operating shaft 7 can engage with the collar portion 1*d* of the bearing 1 at the collar portion 7*b*, to thereby prevent accidental loosening from the bearing 1.

The elastic member 8 formed by curving a resilient metal plate is mounted by being inserted into the operating portion 7*a* of the operating shaft 7 and then disposed between the collar portion 1*d* of the bearing 1 and the collar portion 7*b* of the operating shaft 7.

The elastic member 8 constantly presses the operating shaft 7 backwardly, and when the operating shaft 7 is forced back forwardly, the elastic member 8 serves to prevent the collar portion 7*b* from hitting against the collar portion 1*d* and at the same time to mitigate an impact of the elastic member 8 against the collar portion 1*d*, thus reducing a hitting sound.

At the rear of the rotary electrical component D the push switch P is attached by a mounting plate 9. The push switch P is comprised of a stationary contact 11 embedded in a casing 10 produced of a synthetic resin molding, a moving contact 12 disposed within the casing 10, a dome-shaped rubber member 13 arranged inside the casing 10 and so disposed as to cover the moving contact 12, and a plate portion 14 which retains the rubber member 13.

The rubber member 13 has a flat dome-shaped top portion, and a recess 13*a* is formed at the center, that is, in a position on the straight line of the axis of the operating shaft; and when the push switch P is mounted at the rear of the rotary electrical component D, the rubber member 13 is disposed in a position on the straight line of the engaging portion 7*d* of the operating shaft 7.

A connecting member 15 produced of a synthetic resin molding is comprised of an approximately conical base portion 15*b* having an engaging portion 15*a* which is a hole, an overhanging portion 15*c* having a flat surface which extends from one end of the base portion 15*b*, and a projecting portion 15*d* provided at the center of the overhanging portion 15*c*.

The connecting member 15 is mounted, with its base portion 15*b* inserted in the hole 4*a* of the mounting base 4 and the hole 2*f* of the insulating member 2*e* of the rotating body 2, the engaging portion 7*d* of the operating shaft 7 fitted in a hole provided in the engaging portion 15*a*, and with the projecting portion 15*d* fitted in the recess 13*a* of the rubber member 13, by overlapping the flat surface of the overhanging portion 15*c* on the flat surface of the top portion of the rubber member 13, and housing and retaining the overhanging portion 15*c* within the housing section 4*b* which is a recess section formed in the mounting base 4.

The connecting member 15 that has been mounted as described above is mounted with its engaging portion 15*a* and projecting portion 15*d* positioned on the axis S of the operating shaft 7. The connecting member 15 is pressed by the rubber member 13 into contact with the mounting base 4 and retained. The operating shaft 7, therefore, is also pressed forwardly by the connecting member 15.

Mutually sliding points of metal parts, such as the hole of the collar portion 1*d*, a contact portion between the cylindrical portion 2*a* and the through hole 1*b*, etc. are lubricated with grease not depicted.

In the rotary electrical component with a push switch, when the operating shaft 7 is turned in the condition shown in FIG. 1, the collar portion 1*d* is guided by the operating portion 7*a* of the operating shaft 7 and also the root part of the base portion 15*b* of the connecting member 15 attached integrally with the operating shaft 7 is guided by the hole 4*a* of the mounting base 4. That is, the operating shaft supported at two points is rotated and accordingly the rotating body 2 is rotated by the operating shaft 7, while making a click operation.

With the rotation of the rotating body 2, the moving contact 3 turns to be in contact with or separate from the stationary contact 4 to change over the contact point of them, thereby operating the rotary electrical component D.

In the state shown in FIG. 1, when the operating shaft 7 is pressed to move in the axial direction, the operating portion 7*a* and the non-round portion 7*c* move with the collar portion 1*d* and the hole 2*a* as guides, respectively. The operating shaft 7 axially moves the connecting member 15. The connecting member 15 pushes the rubber member 13 with the projection 15*d* and the flat surface of the overhanging portion 15*c*.

Then, as shown in FIG. 3, the rubber member 13 thus pushed deflects to press the moving contact 12 into contact with the stationary contact 11 to be in ON state.

When the pressure applied to the operating shaft 7 is removed from this state, the rubber member 13 deflects back to its original state with its own resilience, and therefore the connecting member 15 and the operating shaft 7 are pushed back by the rubber member 13.

At this time, the return impact of the operating shaft 7 is mitigated to largely reduce the hitting sound by the spring member 8 interposed between the collar portion 7*b* of the operating shaft and the collar portion 1*d* of the bearing 1.

The base portion 15*b* is approximately conical, that is, tapered, and therefore will not be caught by the hole 4*a*.

When the movement of the collar portion 7*b* of the operating shaft 7 is stopped by the collar portion 1*d*, and the overhanging portion 15*c* of the connecting member 15 is held by the housing section 4*b* of the mounting base 4 to stop moving, the moving contact 12 is reset by its own resilience back to its original position, thus being in OFF state as shown in FIG. 1.

The rotary electrical component D and the push switch P are operated as heretofore described.

In the present embodiment, since the operating portion 7*a* is guided by the collar 1*d* when operated, a distance from the other guide portion may be increased, and also grease may be applied to a part of the collar portion 7*b* which, as a guide, is in contact with the cylindrical portion 1*c*. In this case, the operating shaft is supported at the large-diameter portion and therefore can provide a feeling of smooth and stabilized operation.

It should be noticed that in the present embodiment the relationship between the recess 13*a* of the rubber member 13 and the projection 15*d* of the connecting member 15 may be reversed; that is, the projection may be formed on the rubber member 13, and the recess may be made in the connecting member 15.

FIG. 4 shows another rotary electrical component with a push switch of the present invention. According to this embodiment, a projection 7*e* is formed in the collar portion 7*b* of the operating shaft 7 in a position opposite to the collar portion 1*d* of the bearing 1, and a gap Y1 located between the forward end of the projection 7*e* and the collar portion 1*d* is made narrower than a gap Y2 between the collar portion 7*b* and the collar portion 1*d* with the elastic member 8 interposed therebetween, so that when the operating shaft 7 is moved back to the original position with a great force, the projection 7*e* will comes into contact with the collar portion 1*d*, to thereby prevent permanent set or plastic deformation of the elastic member 8.

Furthermore, the projection 7*e* may be provided on the collar portion 1*d* side.

The present invention, therefore, can provide an easy-to-assemble, low-cost rotary electrical component with a push switch, in which the collar portion 1*d* is provided at the end of the bearing 1 to close a part of the through hole 1*b*, thereby to position the collar portion 7*b* of the operating shaft 7 within the through hole 1*b* and to lock the operating shaft 7 from accidental loosening from position by the collar portion 1*d* of the bearing 1. Therefore, since no other locking part is needed, the quantity of component parts can be decreased.

The present invention can also provide a rotary electrical component with a push switch, in which the operating shaft 7 rotates smoothly if designed to rotate with the large-diameter collar portion 7*b* being supported by the cylindrical portion 1*c* of the bearing 1. The operating portion 7*a* of the operating shaft 7 is supported by the collar portion 1d of the bearing 1, so that the operating shaft 7 is supported at two points of the collar portion 7*b* and the operating portion 7*a*, thereby ensuring smooth, stabilized rotation and movement of the operating shaft 7.

Interposing the elastic member 8 between the collar portion 1*d* of the bearing 1 and the collar portion 7*b* of the operating shaft 7 can diminish impact at the time of backward movement of the operating shaft 7 and accordingly reduce a sound of impact, thus providing a quality rotary electrical component with a push switch which produces no grating sound.

Furthermore, it is possible to provide a rotary electrical component of simple structure with a push switch which has a low-cost elastic member 8 made of a curved metal plate.

Furthermore, since a projection is formed on one of the collar portions 1*d* and 7*b*, and the gap Y1 between the forward end of the projection and the collar portion is made smaller than the gap Y2 between the collar portions 1*d* and 7*b*, it is possible to provide an excellent rotary electrical component with a push switch which produces no grading sound and can prevent permanent set and plastic deformation of the elastic member 8 and maintain specific resilience for a prolonged period of time.

What is claimed is:

1. A rotary electrical component with push switch, comprising: a bearing having a through hole and a collar portion provided at a front end to close a part of said through hole; a rotary electrical component having a rotating body with a hole; a push switch disposed at a side of said rotary electrical component opposite rotating body and having a moving contact and a stationary contact; and an operating shaft inserted into said through hole of said bearing and said hole of said rotating body having a collar portion, wherein said collar portion of said operating shaft is positioned within said through hole of said bearing, to thereby retain, by said through hole of said bearing, to thereby retain, by said collar portion of said bearing, said operating shaft from accidentally loosening from position; with said operating shaft rotating, said rotating body is rotated to operate said rotary electrical component; said operating shaft is axially moved to actuate said push switch; and an elastic member mounted between said collar portion of said bearing and said collar portion of said operating shaft within said through hole of said bearing, wherein said elastic member exerts a force on said collar portion of said bearing and said collar portion of said operating shaft when said operating shaft is not subject to axial movement.

2. A rotary electrical component with push switch according to claim 1, wherein a projection is provided on at least either said collar portion of said bearing or said collar portion of said operating shaft, on a side where said collar portion of said bearing and said collar portion of said operating shaft face each other, to provide a smaller gap between said projection and said collar portion than a gap between said collar portion of said bearing and said collar portion of said operating shaft where said elastic member is interposed.

3. A rotary electrical component with push switch comprising: a bearing having a through hole and a collar portion provided at a front end to close a part of said through hole; a rotary electrical component having a rotating body with a hole; a push switch disposed at a side of said rotary electrical component opposite rotating body and having a moving contact and a stationary contact; and an operating shaft inserted into said through hole of said bearing and said hole of said rotating body having a collar portion, wherein said collar portion of said operating shaft is positioned within said through hole of said bearing, to thereby retain, by said through hole of said bearing, to thereby retain, by said collar portion of said bearing, said operating shaft from accidentally loosening from position; with said operating shaft rotating, said rotating body is rotated to operate said rotary electrical component; said operating shaft is axially moved to actuate said push switch; and a curved elastic member mounted between said collar portion of said bearing and said collar portion of said operating shaft within said through hole of said bearing, wherein said elastic member is formed of a curved metal plate.

* * * * *